United States Patent [19]

Speicher

[11] Patent Number: 4,848,942

[45] Date of Patent: Jul. 18, 1989

[54] METHOD AND APPARATUS FOR MARKING ON AN ARCUATE SURFACE

[75] Inventor: Edwin W. Speicher, Pittsburgh, Pa.

[73] Assignee: M. E. Cunningham Company, Ingomar, Pa.

[21] Appl. No.: 157,920

[22] Filed: Feb. 19, 1988

Related U.S. Application Data

[63] Continuation of Ser. No. 930,660, Nov. 13, 1986, abandoned.

[51] Int. Cl.[4] ..... B41F 17/00

[52] U.S. Cl. ..... 400/121; 400/128; 400/132

[58] Field of Search ..... 101/4, 7; 400/121, 128, 400/130, 132

[56] References Cited

U.S. PATENT DOCUMENTS

| | | | |
|---|---|---|---|
| 441,822 | 12/1890 | Browning | 101/4 |
| 445,040 | 1/1891 | Calder | 400/181 |
| 756,649 | 4/1904 | Kaisling | 400/181 |
| 2,002,847 | 5/1935 | Atti | 101/4 |
| 3,086,458 | 4/1963 | Shafer | 101/38 R |
| 3,097,593 | 7/1963 | Makowski | 101/38 R |
| 3,226,530 | 12/1965 | Greenblott | 400/181 |
| 3,811,522 | 5/1974 | Wolf | 101/4 |
| 4,043,262 | 8/1977 | Kajimoto | 101/38 R |
| 4,506,999 | 3/1985 | Robertson | 400/181 |
| 4,557,191 | 12/1985 | Speicher | 101/4 |

FOREIGN PATENT DOCUMENTS

| | | | |
|---|---|---|---|
| 2715000 | 10/1978 | Fed. Rep. of Germany | 101/4 |
| 3247577 | 7/1984 | Fed. Rep. of Germany | 101/4 |
| 3437171 | 4/1986 | Fed. Rep. of Germany | 101/4 |

*Primary Examiner*—Clifford D. Crowder
*Attorney, Agent, or Firm*—Stanley J. Price, Jr.

[57] ABSTRACT

A marking device includes a plurality of individual marking pin assemblies. Each marking pin assembly is spaced an angular distance from each adjacent marking pin assembly in the marking device to form a generally fan-shaped array. An arcuate object to be marked by the marking device is placed on an object support plate. As the arcuate object is rotated on the object support plate, the plurality of marking pin assemblies in the marking device operate to selectively imprint a plurality of preselected characters in the circumference of the arcuate object.

16 Claims, 4 Drawing Sheets

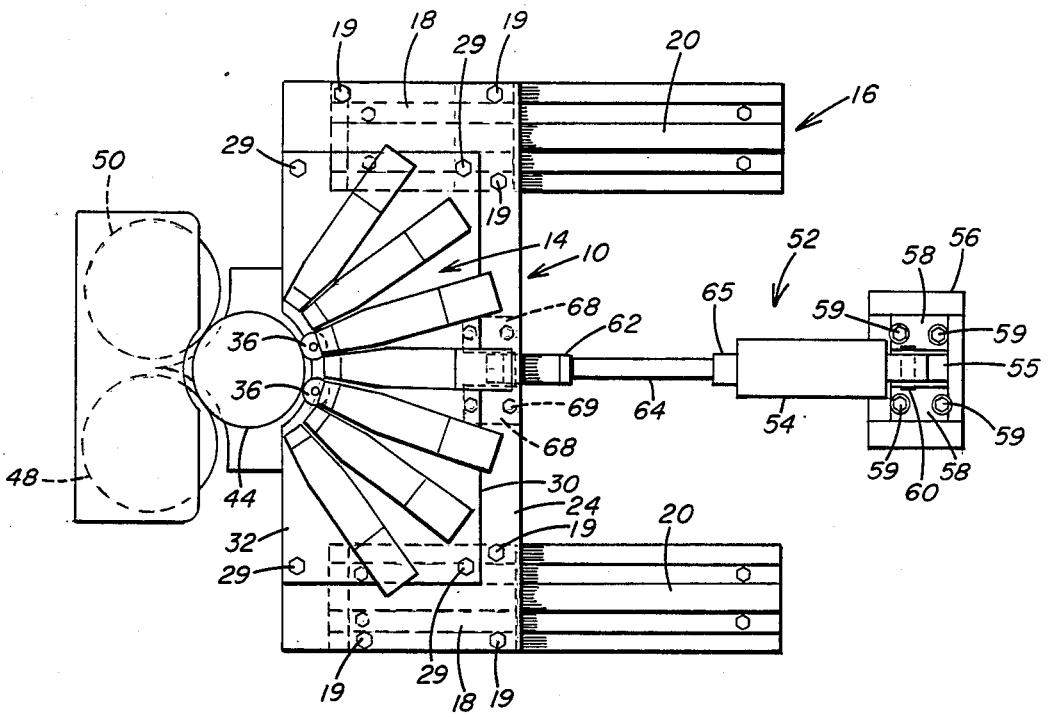
FIG. 1 C14
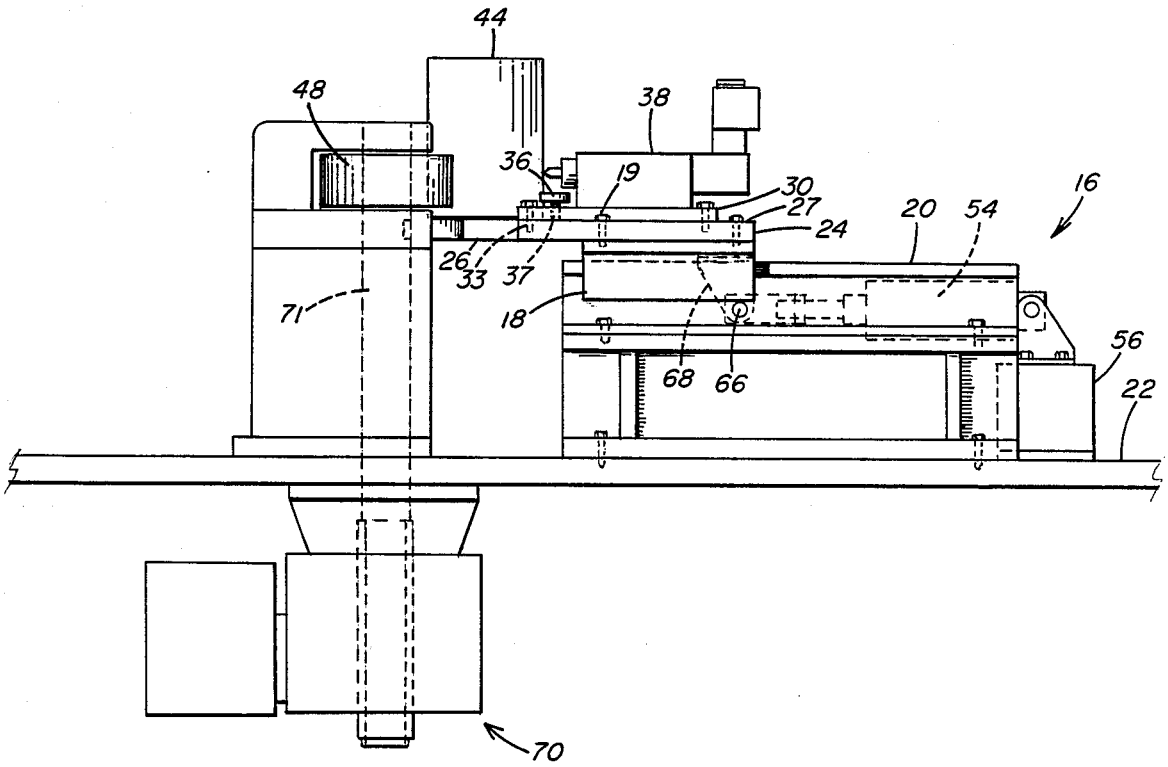
FIG. 2

METHOD AND APPARATUS FOR MARKING ON AN ARCUATE SURFACE

CROSS REFERENCE TO RELATED APPLICATIONS

This application is a continuation of copending application Ser. No. 930,660, filed on Nov. 13, 1986, now abandoned, entitled "Method And Apparatus For Marking On An Arcuate Surface".

BACKGROUND OF THE INVENTION

1. Field of the Invention

This invention relates to a method and apparatus for marking the surface of an object, and more particularly, to a method and apparatus for imprinting a preselected array of characters in the circumference of an arcuate object.

2. Description of the Prior Art

Dot matrix marking devices that utilize individual marking pins to imprint alphanumeric characters in the generally flat surface of a workpiece are well known.

British Pat. No. 2,002,694 discloses a programmable dot matrix type of engraver for impressing a selected size of alphanumeric characters in a workpiece. The engraver is computer controlled to provide selective continuous marking of the workpiece to overcome the delays encountered with manual engravers. An engraving tool is supported on an arm which is movable on a carriage by a leadscrew rotated by a stepping motor. The carriage is movably mounted on a horizontal arm that is, in turn, supported by a vertical column above a base on which the workpiece to be marked is stationarily positioned. With this arrangement, the engraving tool is movable along horizontal X and Y axes. The engraving tool includes a punch which is remotely controlled by a central processing unit through a solenoid operated air valve to form the desired dot matrix character whereby the size of the figure engraved is determined by the number of stepping motor steps between each point of the $7\times5$ matrix. Furthermore, similar to the wire dot matrix printers for computers, there is now also available an engraver with marking pins selectively actuated and arranged in a straight line configuration which can form alphanumeric characters by collectively traversing a given number of lateral units.

U.S. Pat. No. 4,506,999 discloses pneumatically controlled apparatus that includes an array of pins utilized to emboss alphanumeric characters in a workpiece. Seven pins move across the workpiece and selectively mark the workpiece with the desired characters. The angular arrangement of the pins determines the height of the characters and rotation of the head adjusts the angle of the line of pins. The angular adjustment is made manually by means of ball lock pins.

U.S. Pat. No. 4,591,279 discloses a marking head assembly that is pivotally mounted on a plate and carries a plurality of impact pins which are reciprocated into and out of contact with the relatively flat surface of a workpiece by operation of programmable solenoid valves. An indexing wheel adjusts the angular position of the marking head assembly to control the size of the characters formed by the pins impacting the workpiece. A ballscrew drive connects the plate to a frame for imparting longitudinal movement of the plate as the marking head assembly imprints a plurality of marks in the surface of the workpiece.

While it has been suggested by the prior art devices to utilize individual marking pins reciprocated into and out of contact with the surface of a workpiece to form a dot matrix array of alphanumeric characters, these devices are limited in that they will only imprint a dot matrix array in a relatively flat workpiece. There is a need for an improved dot matrix marking device that is computer controlled to rapidly mark the circumference of an arcuate object with a dot matrix array of alpha or numeric characters and also a combination of alphanumeric characters. The dot matrix marking device must be adaptable for marking the circumference of arcuate objects of varying diameters.

SUMMARY OF THE INVENTION

In accordance with the present invention there is provided apparatus for placing an object having an arcuate surface in a position for marking by a marking device that includes an object support member and a positioning means. The object to be marked is placed on the object support member. A plurality of rollers contact the arcuate surface of the object at preselected locations around the circumference of the object to maintain the object at a rotatably fixed position on the object support member.

Further in accordance with the present invention there is provided apparatus for marking the circumference of an object having an arcuate surface that includes a marking device secured to a mounting member. The marking device includes a plurality of individual marking pin assemblies. Each marking pin assembly is spaced an angular distance from each adjacent marking pin assembly in the marking device to form a generally fan-shaped array. As the arcuate object is rotated on the object support member within the plurality of positioning rollers, the plurality of marking pin assemblies operate to selectively imprint a plurality of marks in the circumference of the arcuate object.

Additionally, in accordance with the present invention there is provided a method for marking an arcuate surface that includes positioning an object having an arcuate surface on an object support member so that the object may be rotated on the object support member. As the object is rotated on the object support member, a marking device having a plurality of individual marking pin assemblies operates to selectively imprint a plurality of marks in the circumference of the object.

Accordingly, the principal object of the present invention is to provide a marking device for imprinting a preselected array of characters in the circumference of an arcuate object.

Another object of the present invention is to provide a marking device that includes a plurality of individual marking pin assemblies, each individual marking pin assembly being spaced an angular distance from each adjacent marking pin assembly in the marking device to form a generally fan-shaped array.

An additional object of the present invention is to provide a method for rotating an arcuate object relative to a marking device while the circumference of the arcuate object is being marked by the marking device.

These and other objects of the present invention will be more completely disclosed and described in the following specification, the accompanying drawings and the appended claims.

BRIEF DESCRIPTION OF THE DRAWINGS

FIG. 1 is a top plan view of a marking apparatus supported on a pair of pedestals in position to mark the circumference of an arcuate object.

FIG. 2 is a view in side elevation of a marking apparatus depicting one marking head assembly positioned on a support system to mark the circumference of an arcuate object.

DESCRIPTION OF THE PREFERRED EMBODIMENTS

Figure 3:
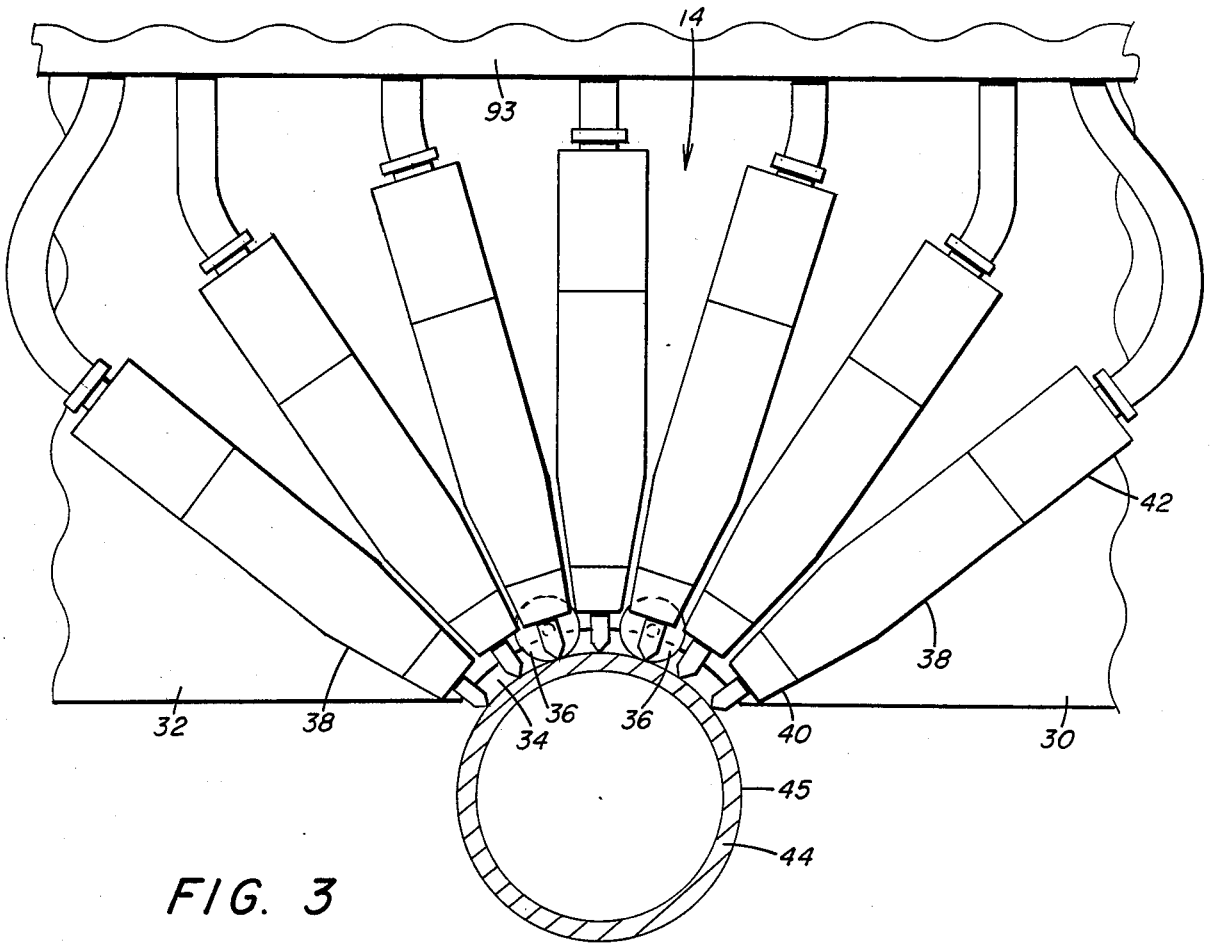
FIG. 3 is a top plan view of a plurality of individual marking head assemblies positioned on a mounting plate to mark the circumference of an arcuate object.

Referring to the drawings and particularly to FIGS. 1 and 2, there is illustrated a marking apparatus generally designated by the numeral 10 for supporting a marking device generally designated by the numeral 14 for movement into and out of position for marking the arcuate surface of an object. Marking device 14 is adaptable for impressing a preselected array of alphanumeric characters on many types of arcuate contour objects which may be composed of glass, metal or plastic.

As seen in FIGS. 1 and 2, marking apparatus 10 is mounted for movement on a support system generally designated by the numeral 16 that includes a pair of spaced apart, horizontally extending parallel guides 18 supported by pedestals 20. Marking apparatus 10 and support system 16 are mounted as a unit on platform 22.

Although FIGS. 1 and 2 show marking apparatus 10 and support system 16 positioned horizontally on platform 22, it must be pointed out that this is done for illustrative purposes only. The invention will also operate with marking apparatus 10 and support system 16 mounted as a unit and positioned vertically.

Marking apparatus 10 includes an object support member 24. Spaced apart, horizontally extending parallel guides 18 are secured to object support member bottom surface 26 by bolts 19. Parallel guides 18 are positioned on object support member bottom surface 26 to be aligned on support pedestals 20.

Marking apparatus 10 also includes mounting plate 30. Mounting plate 30 is secured to object support member top surface 27 by four bolts 29. A plurality of rollers 36 are positioned on mounting plate top surface 32. Each roller 36 communicates with stub shaft 37 that extends outwardly from mounting plate top surface 32 for rotation on stub shaft 37. As will be explained later in greater detail, mounting plate 30 is designed to be removable, so that as the diameter of the arcuate object to be marked changes, the proper mounting plate 30 is installed.

As shown in FIG. 3, mounting plate 30 includes an arcuately notched area 34 and the plurality of rollers 36 previously described. Rollers 36 are positioned on mounting plate top surface 32 so that a portion of each roller 36 extends over arcuately notched area 34.

Marking apparatus 10 also includes a marking device generally designated by the numeral 14. Marking device 14, which will be explained later in greater detail, is positioned on mounting plate top surface 32.

As shown in FIGS. 1 and 2, marking apparatus 10 is moved on support pedestals 20 by a drive means generally designated by the numeral 52. Drive means 52 includes actuating cylinder 54 and pedestal 56. Pedestal 56 is secured to platform 22 by suitable means (not shown). A pair of first anchor brackets 58 are secured on pedestal 56 by four bolts 59 in a spaced apart relationship to accept cylinder stationary end yoke 55. First anchor pin 60 passes through both first anchor bracket 58 retainer holes (not shown) and cylinder stationary end yoke 55 retainer hole (not shown) to maintain stationary end yoke 55 within first anchor brackets 58. A pair of second anchor brackets 68 are secured to object support member bottom surface 26 by four bolts 69 in a spaced apart relationship to accept cylinder rod end 62. Cylinder rod end 62 is threadedly connected to movable cylinder rod 64. Second anchor pin 66 passes through both second anchor bracket 68 retainer holes (not shown) and cylinder rod end 62 retainer hole (not shown) to maintain cylinder rod end 62 within second anchor brackets 68.

Movement of marking apparatus 10 on support pedestals 20 is accomplished by movement of cylinder rod 64 in relation to actuating cylinder 54. As cylinder rod 64 is moved into actuating cylinder 54, marking apparatus 10 moves on support pedestals 20 in a direction towards pedestal 56. As cylinder rod 64 is moved out of actuating cylinder 54, marking apparatus 10 moves on support pedestals 20 in a direction away from pedestal 56. Moving cylinder rod 64 into actuating cylinder 54 until cylinder rod end 64 contacts cylinder bushing 65 will position marking apparatus 10 on support pedestals 20 in a non-marking or idle position.

In order to mark the circumference of an arcuate object, such as object 44 shown in FIGS. 1 and 2, marking apparatus 10 is first positioned on support pedestals 20 in the non-marking or idle position. Object 44 is placed on object support member top surface 27 so that the arcuate surface of object 44 contacts the plurality of rollers 36. As cylinder rod 64 is moved out of actuating cylinder 54, marking apparatus 10, which includes object 44, is moved on support pedestals 20 in a direction towards driver roll 48 and encoder roll 50. Driver roll 48 and encoder roll 50 are positioned for rotation in the same plane as the plurality of rollers 36. Both driver roll 48 and encoder roll 50 are positioned above platform 22 on an axis perpendicular to the axis of travel of cylinder rod 64. Cylinder rod 64 is moved out of actuating cylinder 54 until the arcuate surface of object 44 contacts driver roll 48 and encoder roll 50. The application of a constant pneumatic source (not shown) to cylinder rod 64 will maintain its position relative to actuating cylinder 54 to position object 44 within the plurality of rollers 36, driver roll 48 and encoder roll 50.

In order to mark the arcuate surface of object 44, object 44 is rotated on object support member top surface 27 within rollers 36, driver roll 48 and encoder roll 50. As shown in FIG. 2, driver roll 48 is connected to a driver roll motor generally designated by the numeral 70 by means of shaft 71. Driver roll motor 70 may either be electrically or pneumatically operated. As driver roll motor 70 operates, shaft 71 rotates driver roll 48 to rotate object 44 within rollers 36, driver roll 48 and encoder roll 50. As will be explained later in greater detail, encoder roll 50 monitors the amount of rotational travel of object 44.

As arcuate object 44 rotates on object support member top surface 27, the marking device generally designated by the numeral 14 operates to imprint a preselected array of dot matrix characters in the circumference of arcuate object 44.

The marking device generally designated by the numeral 14 in FIGS. 1 and 2 is further illustrated in FIG. 3. As seen in FIG. 3, the marking device generally designated by the numeral 14 includes a plurality of individual marking head assemblies 38 secured to mounting plate top surface 32. Each marking head assembly 38 includes a pin outlet end portion 40 and a solenoid end portion 42. Each marking head assembly 38 is spaced an angular distance from each adjacent marking head assembly 38 on mounting plate top surface 32 to form a generally fan-shaped array. The plurality of individual marking head assemblies 38 are arranged on mounting plate top surface 32 so that the plurality of pin outlet end portions 40 face towards arcuate object 44.

Figure 6:
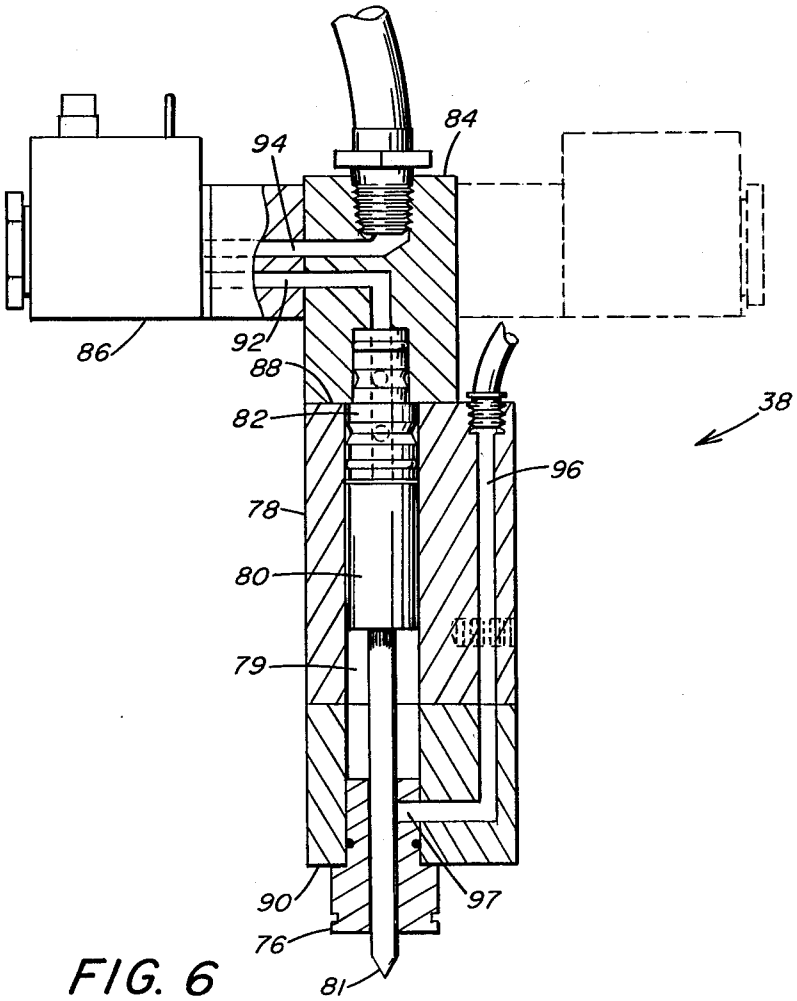
FIG. 6 is a partially fragmentary view in side elevation of an individual marking head assembly illustrating the marking pin assembly retained in a bore and a valve block and solenoid for moving the marking pin assembly in the bore, and illustrating the solenoid rotated 180° from a position illustrated in phantom.
Figure 4:
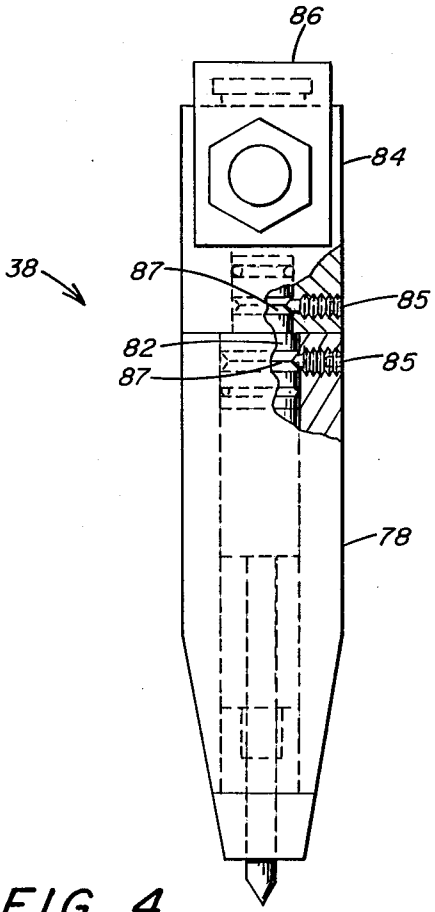
FIG. 4 is a partially fragmentary top plan view of an individual marking head assembly illustrating a valve block assembly connected to a marking head body and illustrating a marking pin assembly in phantom.

A detailed view of an individual marking head assembly 38 is shown in FIGS. 4 and 6. Marking head assembly 38 includes a marking head body 78 and a marking pin assembly 80. Marking head body 78 has a uniform diameter bore 79 which extends completely through body 78 from air inlet end surface 88 to pin outlet end surface 90. Marking pin assembly 80 is slidably retained in bore 79 with pin assembly striking end portion 81 arranged to pass through pin outlet end surface 90. Guide bushing 76 communicates with pin outlet end surface 90 to guide striking end portion 81 as marking pin assembly 80 moves within bore 79.

Movement of marking pin assembly 80 within bore 79 is controlled by valve block 84. Valve block 84 rotatably communicates with bore 79 at air inlet end surface 88 by means of coupling 82. A pair of set screws 85 are threadedly advanced into marking head body 78 and valve block 84 until they contact coupling retaining grooves 87. In this manner, valve block 84 can be locked on coupling 82 in a preselected position relative to marking head body 78.

Valve block 84 includes main air passageway 94 and air inlet passageway 92. Manifold 93, shown in FIG. 3, supplies constant pneumatic pressure to main air passageway 94. Movement of marking pin assembly 80 is initiated by energizing solenoid 86, shown in FIG. 6, to connect main air passageway 94 with air inlet passageway 92. Flow of pressurized air through air inlet passageway 92 into bore 79 moves marking pin assembly 80 through bore 79 in a direction towards pin outlet end surface 90 to contact the arcuate surface of object 44. Pin assembly striking end portion 81 thereby indents and individual dot in the circumference of arcuate object 44 which forms part of the desired dot matrix character.

Return air passageway 96 provides a means for retracting marking pin assembly 80 into bore 79 after an individual dot is indented into the arcuate surface of object 44 by pin assembly striking end portion 81. Return air passageway 96 communicates with bore 79 through inlet hole 97 in bushing 76. Guide bushing 76 is inserted into bore 79 so that inlet hole 97 is aligned with return air passageway 96. A return air source (not shown) supplies constant pneumatic pressure to return air passageway 96. This constant pneumatic pressure is introduced into bore 79 through inlet hole 97.

The pressure of the air flowing through return air passageway 96 is less in pneumatic value than the pressure of the air directed through solenoid 86 and introduced into bore 79. Upon actuation of solenoid 86, marking pin assembly 80 will overcome the resistance provided by the constant air supplied through passageway 96 and move to allow pin assembly striking end portion 81 to impact the arcuate surface of object 44. As solenoid 86 is de-energized, the flow of air through air inlet passageway 92 and introduced into bore 79 is cut off. The flow of constant air through passageway 96 will act to retract marking pin assembly 80 into bore 79.

As seen, the plurality of marking head assemblies 38 shown in FIGS. 1 and 3 are selectively operated to imprint a preselected array of dot matrix characters in the circumference of arcuate object 44. By controlling the operation of electric solenoids 86, marking pin assemblies 80 are extended and retracted in a controlled manner to indent the circumference of object 44 with dots to form a single line dot matrix array of characters.

Figure 7:
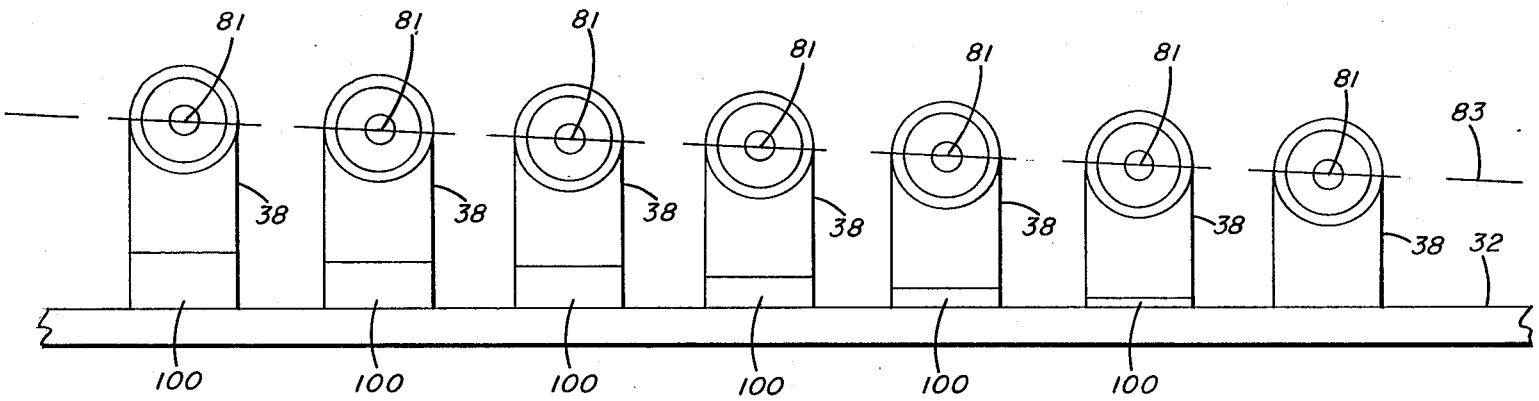
FIG. 7 is a schematic illustration of a plurality of individual marking head assemblies spaced preselected distances from a mounting plate.

The height of the characters imprinted in the circumference of arcuate object 44 by the plurality of individual marking head assemblies 38 is controlled by shimming means shown schematically in FIG. 7 generally designated by the numeral 100. As seen in FIG. 7, the striking end portion 81 of each marking head assembly 38 lies in a plane schematically represented by dotted line 83 that is angularly spaced from mounting plate top surface 32. Each striking end portion 81 represents an individual mark indented into the circumference of arcuate object 44. The height of the characters imprinted in the circumference of arcuate object 44 is determined by the angular spacing between the plane represented by dotted line 83 and mounting plate top surface 32. Each marking head assembly 38 is spaced from mounting plate top surface 32 so that striking end portion 81 of each marking head assembly 38 lies in the plane represented by dotted line 83. In order to place striking end portion 81 of each marking head assembly 38 in the plane represented by dotted line 83, each marking head assembly 38 is spaced, or shimmed, from mounting plate top surface 32 a greater distance than the previous adjacent marking head assembly 38. As seen in FIG. 7, as the shims generally designated by the numeral 100 become progressively thicker, the distances between the individual striking end portions 81 and mounting plate top surface 32 increase. The height of the characters imprinted on the circumference of arcuate object 44 is determined by the difference between the thickest shim and the thinnest shim used to place each striking end portion 81 of each marking head assembly 38 in the plane represented by dotted line 83. As an example, if the first marking head assembly 38 in the array is secured directly to mounting plate top surface 32 and the last marking head assembly 38 in the array is spaced, or shimmed, from mounting plate top surface 32 one quarter inch, the height of the characters imprinted in the circumference of arcuate object 44 will be one quarter inch. The spacing, or thickness of the shims, should increase in equal increments between the first and last marking head assembly 38 and mounting plate top surface 32 to ensure character legibility.

As previously described, as arcuate object 44 rotates on object support member top surface 27, the plurality of individual marking head assemblies 38 selectively operate to imprint a preselected array of characters in the circumference of arcuate object 44. It should be understood that, although only object 44 is shown in FIGS. 1 and 2, this invention will operate to imprint a preselected array of characters in the circumference of an object of any preselected diameter.

As seen in FIG. 1, arcuate object 44 is positioned on object support member top surface 27 within rollers 36, driver roll 48 and encoder roll 50. The arcuate surface of object 44 contacts the arcuate surfaces of rollers 36, driver roll 48 and encoder roll 50 so that arcuate object 44 can be rotated by driver roll 48.

The plurality of rollers 36 shown in FIG. 1 are selectively positioned on mounting plate top surface 32 to contact the arcuate surface of objects falling within a preselected range of diameters. Mounting plate 30 is designed to be replaceable so that, if an arcuate object to be marked does not fall within this preselected range of diameters, mounting plate 30 shown in FIG. 1 can be replaced with a different mounting plate 30 having rollers 36 positioned at predetermined locations on mounting plate top surface 32 to contact the arcuate surface of the object to be marked.

Figure 5:
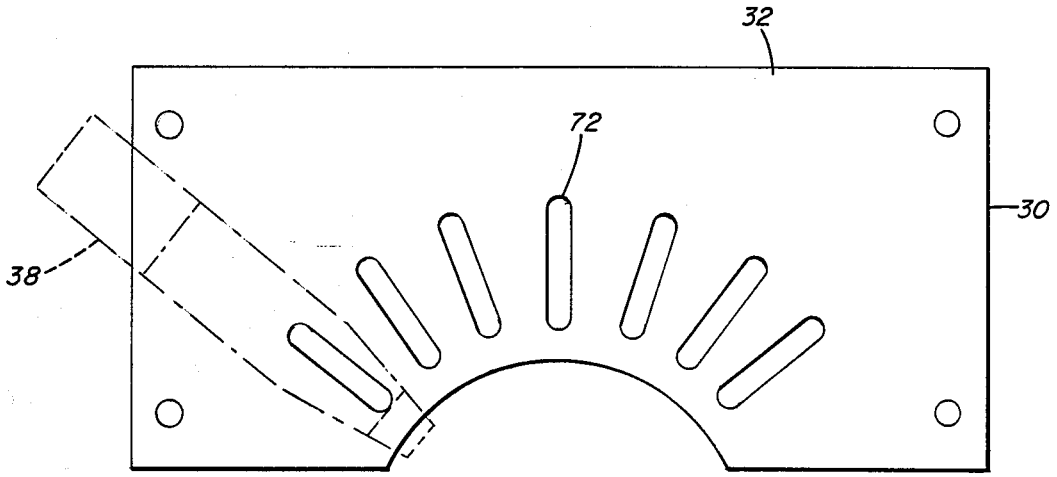
FIG. 5 is a top plan view of the mounting plate upon which the individual marking head assemblies are slidably secured illustrating the linear guide slots for selective positioning of the individual marking head assemblies on the mounting plate and illustrating a marking pin assembly in phantom.

Further, as seen in FIGS. 3 and 5, as the diameter of the arcuate object to be marked by the plurality of marking head assemblies 38 varies within a range of diameters, means is provided to adjust the position of the individual marking head assemblies 38 on mounting plate top surface 32 to maintain a preselected distance between the arcuate surface 45 of the object to be marked and the plurality of marking pin assembly pin outlet end portions 40.

Referring to FIG. 5, mounting plate 30 includes a plurality of separate, linear guide slots generally designated by the numeral 72, that extend completely through mounting plate 30 from mounting plate top surface 32 to mounting plate bottom surface 33, shown in FIG. 2. As seen in FIG. 5, each marking head assembly 38 is slidably secured to mounting plate top surface 32 within a guide slot 72 by suitable means (not shown). Each marking head assembly 38 is positioned at a preselected location on mounting plate top surface 32 within a separate guide slot 72 to ensure that the preselected distance between arcuate surface 45 and the plurality of marking pin assembly pin outlet end portions 40 is maintained.

The apparatus for selecting the dot matrix array of characters to be formed by the plurality of pin assembly striking end portions 81 impacting the arcuate surface of object 44 is located at an operator's terminal which is connected to a computer operated controller. From the controller, the characters to be imprinted on the circumference of the arcuate object are selected and the selection is made from a data entry terminal which is located remote from the location of the plurality of marking head assemblies 38. The controller generates data and character signals which are transmitted to the plurality of electric solenoids 86.

The sequential operation of the plurality of electric solenoids 86 to extend and retract the marking pin assemblies 80 is controlled by encoder roll 50 shown in FIG. 1. Encoder roll 50 is responsive to the rate of rotation of driver roll 48. Encoder roll 50 monitors or senses the rate of rotation of driver roll 48 and generates responsive signals known as tach pulses. The tach pulses are directly proportional to the rate of rotation of driver roll 48 and are transmitted as feedback signals to the controller. The controller processes the feedback signals to sequence the operation of the electric solenoids 86 for a preselected rate of impact of the marking pin assemblies 80 with the arcuate surface of object 44. Accordingly, the rate of impact is adjustable.

The feedback signals generated by encoder roll 50 upon rotation of driver roll 48 are transmitted in a desired format to a controller. The feedback signals are processed for transmitting corresponding signals for sequencing the opening and closing of electric solenoids 86 to maintain a desired width of the characters. With the above-described arrangement, encoder roll 50 sequences actuation of electric solenoids 86 for imprinting a line of characters in the circumference of the object to be marked.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for marking on an arcuate surface comprising, marking means for marking the circumference of an object having an arcuate surface with a plurality of characters of preselected height, said marking means including a plurality of marking head assemblies spaced from each other by a preselected angular distance to form a generally fan-shaped array, said plurality of marking head assemblies angularly spaced from a circumference of said object by a preselected degree to control said height of said characters, mounting means for supporting said marking means, object support means for supporting said object having said arcuate surface, said object support means positioned to provide that a longitudinal axis of said object is substantially perpendicular to said plurality of marking head assemblies, positioning means for positioning said arcuate object on said object support means, rotating means for rotating said object on said object support means relative to said marking means while the circumference of said arcuate object is being marked by said marking means, means to operate said plurality of marking head assemblies to selectively imprint a plurality of marks in the circumference of said arcuate object to form said plurality of characters, and control means to control the rate of rotation of said object on said object support means relative to said marking means while the circumference of said arcuate object is being marked by said marking means.

2. Apparatus for marking on an arcuate surface as set forth in claim 1 in which, said mounting means is maintained at a fixed position relative to said object support means while said object rotates on said object support means.

3. Apparatus for marking on an arcuate surface as set forth in claim 1 in which, said plurality of marking head assemblies in said marking means are located in the same plane, said plane being angularly spaced from said object support means to maintain said plurality of marking head assemblies in angular relation with a circumference of said arcuate surface.

4. Apparatus for marking on an arcuate surface as set forth in claim 1 in which, said mounting means includes a plurality of separate linear guide slots, each said marking head assembly being slidably secured to a separate guide slot to permit individual positioning of said marking head assemblies on said mounting means.

5. Apparatus for marking on an arcuate surface as set forth in claim 1 in which each said marking head assembly includes, a marking head body, said marking head body having a bore and having an air inlet end portion and a pin outlet end portion, a marking pin assembly having a striking end portion and a drive end portion, said marking pin assembly being slidably retained within said bore with said striking end portion arranged to extend through said pin outlet end portion, valve means positioned in said air inlet end portion, said valve means operable to control the flow of air to said air inlet end portion, solenoid means communicating with said valve means to open and close said valve means and thereby control the movement of said marking pin assembly within said bore, and means communicating with said bore to position said marking pin assembly in said bore at said air inlet end portion.

6. A method for marking on an arcuate surface comprising the steps of, providing a marking means for marking the circumference of an object having an arcuate surface with a plurality of characters of preselected height, said marking means including a plurality of marking pin assemblies spaced from each other by a preselected angular distance to form a generally fan-shaped array, angularly spacing said plurality of marking pin assemblies from a circumference of said object by a preselected degree to control said height of said characters, positioning said object having said arcuate surface on an object support means so that a longitudinal axis of said object is substantially perpendicular to said plurality of marking pin assemblies, rotating said object having said arcuate surface on said object support means, and selectively moving each of said plurality of marking pin assemblies into and out of contact with a circumferential surface of said object to imprint a plurality of marks in said circumferential surface to form said plurality of characters.

7. A method for marking on an arcuate surface as set forth in claim 6 including, controlling the rate of rotation of said object on said object support means as said circumferential surface is marked by said marking means to control the placement of said marks imprinted in said circumference by said marking means.

8. Apparatus for marking on an arcuate surface comprising, marking means for marking the circumference of an object having an arcuate surface with a plurality of characters of preselected height, said marking means including a plurality of marking head assemblies spaced from each other by a preselected angular distance to form a generally fan-shaped array, said plurality of marking head assemblies angularly spaced from a circumference of said object by a preselected degree to control said height of said characters, mounting means for supporting said marking means, said mounting means being replaceable to permit said marking means to mark the circumference of arcuate surfaces of varying diameters, object support means for supporting said object having said arcuate surface, said object support means positioned to provide that a longitudinal axis of said object is substantially perpendicular to said plurality of marking head assemblies, positioning means for positioning said arcuate object on said object support means, rotating means for rotating said object on said object support means relative to said marking means while the circumference of said arcuate object is being marked by said marking means, means to operate said plurality of marking head assemblies to selectively imprint a plurality of marks in the circumference of said arcuate object to form said plurality of characters, and control means to control the rate of rotation of said object on said object support means relative to said marking means while the circumference of said arcuate object is being marked by said marking means.

9. Apparatus for marking on an arcuate surface as set forth in claim 8 in which, said mounting means is maintained at a fixed position relative to said object support means while said object rotates on said object support means.

10. Apparatus for marking on an arcuate surface as set forth in claim 8 in which, said plurality of marking head assemblies in said marking means are located in the same plane, said plane being angularly spaced from said object support means to maintain said plurality of marking head assemblies in angular relation with a circumference of said arcuate surface.

11. Apparatus for marking on an arcuate surface as set forth in claim 8 in which, said mounting means includes a plurality of separate linear guide slots, each said marking head assembly being slidably secured to a separate guide slot to permit individual positioning of said marking head assemblies on said mounting means.

12. Apparatus for marking on an arcuate surface as set forth in claim 8 in which said marking head assembly includes, a marking head body, said marking head body having a bore and having an air inlet end portion and a pin outlet end portion, a marking pin assembly having a striking end portion and a drive end portion, said marking pin assembly being slidably retained within said bore with said striking end portion arranged to extend through said pin outlet end portion, valve means positioned in said air inlet end portion, said valve means operable to control the flow of air to said air inlet end portion, solenoid means communicating with said valve means to open and close said valve means and thereby control the movement of said marking pin assembly within said bore, and means communicating with said bore to position said marking pin assembly in said bore at said air inlet end portion.

13. Apparatus for marking on an arcuate surface as set forth in claim 8 in which, shimming means is provided to angularly space each said marking head assembly from a circumference of said object by a preselected degree to control said height of said characters.

14. A method for marking on an arcuate surface comprising the steps of, providing a marking means for marking the circumference of an object having an arcuate surface with a plurality of characters of preselected height, said marking means including a plurality of marking pin assemblies spaced from each other by a preselected angular distance to form a generally fan-shaped array, angularly spacing said plurality of marking pin assemblies from a circumference of said object by a preselected degree to control said height of said characters, selecting mounting means to support said marking means, the choice of said mounting means determined by the diameter of said object having an arcuate surface to be marked by said marking means, positioning said object having said arcuate surface on an object support means so that a longitudinal axis of said object is substantially perpendicular to said plurality of marking pin assemblies, rotating said object having said arcuate surface on said object support, and selectively moving each of said plurality of marking pin assemblies into and out of contact with a circumferential surface of said object to imprint a plurality of marks in said circumferential surface to form said plurality of characters.

15. A method for marking on an arcuate surface as set forth in claim 14 including, controlling the rate of rotation of said object on said object support means as said circumferential surface is marked by said marking means to control the placement of said marks imprinted in said circumference by said marking means.

16. A method for marking on an arcuate surface as set forth in claim 14 including, angularly spacing by shimming means each marking pin assembly from a circumference of said object by a preselected degree to control said height of said characters.

* * * * *